US007354485B2

(12) United States Patent
Jones

(10) Patent No.: US 7,354,485 B2
(45) Date of Patent: Apr. 8, 2008

(54) CLEANING SOLUTION

(75) Inventor: David H. Jones, Tarzana, CA (US)

(73) Assignee: Earth Alive Resources Inc., Waterloo, Quebec (CA)

( * ) Notice: Subject to any disclaimer, the term of this patent is extended or adjusted under 35 U.S.C. 154(b) by 0 days.

(21) Appl. No.: 11/442,505

(22) Filed: May 25, 2006

(65) Prior Publication Data

US 2006/0266384 A1 Nov. 30, 2006

(30) Foreign Application Priority Data

May 27, 2005 (CA) ..... 2508451

(51) Int. Cl.
*B08B 3/04* (2006.01)

(52) U.S. Cl. ..... 134/34; 134/22.1; 134/22.12; 134/22.19; 134/22.14; 134/42; 510/464; 510/495

(58) Field of Classification Search ..... 134/22.1, 134/22.12, 22.19, 22.14, 34, 42; 510/495, 510/464

See application file for complete search history.

(56) References Cited

U.S. PATENT DOCUMENTS

| | | | | | |
|---|---|---|---|---|---|
| 2,826,552 | A * | 3/1958 | Bonewitz et al. | ..... | 510/426 |
| 3,188,289 | A * | 6/1965 | Kahler et al. | ..... | 210/697 |
| 3,247,120 | A * | 4/1966 | Von Pless | ..... | 510/254 |
| 3,511,707 | A * | 5/1970 | Flamme | ..... | 134/27 |
| 4,882,309 | A * | 11/1989 | Kirchgessner et al. | ..... | 502/401 |
| 5,104,584 | A * | 4/1992 | Kong | ..... | 510/309 |
| 6,288,015 | B1 * | 9/2001 | Moeller et al. | ..... | 510/180 |
| 2002/0044887 | A1 * | 4/2002 | Jones | ..... | 422/28 |
| 2002/0063095 | A1 * | 5/2002 | Jones | ..... | 210/601 |

* cited by examiner

*Primary Examiner*—Sharidan Carrillo
(74) *Attorney, Agent, or Firm*—Eric Fincham

(57) ABSTRACT

A method of cleaning a surface which comprises the step of applying an aqueous cleaning solution to the surface wherein the active cleaning ingredient of the aqueous solution consists essentially of a lignosulfonate. It has been found that lignosulfonate can function as a cleaning agent for a variety of cleaning materials.

6 Claims, No Drawings

CLEANING SOLUTION

FIELD OF THE INVENTION

The present invention relates to a cleaning solution, and more particularly, relates to a novel cleaning solution containing lignin sulfonate as the primary cleaning agent.

BACKGROUND OF THE INVENTION

Many different types of compositions have been developed during the years for cleaning varying substrates. These cleaning substances have included solvents and detergents. While compositions containing various solvents and detergents function effectively, they can, in the case of solvents, be dangerous to employ and the problem of disposal of the solvent is always present.

Detergents have also been widely used; however, they are frequently not as effective as the harsher solvents. Furthermore, biodegradability of detergents is an ever present issue.

SUMMARY OF THE INVENTION

It is an object of the present invention to provide for a cleaning agent, and which cleaning agent is effective and biodegradable.

In one aspect of the present invention, there is provided a method of cleaning a surface, the method comprising the step of applying an aqueous cleaning solution to the surface wherein the active cleaning ingredient of the aqueous cleaning solution consists essentially of a lignosulfonate.

Lignosulfonates have been utilized in cleaning solutions in the prior art. Thus, for example, in U.S. Pat. No. 6,475,290 issued Nov. 5, 2002, there is taught a method for the cleaning of a substrate to remove hydrocarbon therefrom, the method comprising the step of applying to the substrate a composition comprising a lignosulfonate and a microbially effective amount of micro organisms.

Similarly, in U.S. Pat. No. 6,288,015 there is taught a cleaning composition comprising a liquid multi phase composition with at least two continuous phases and which contains a relatively small proportion of a lignosulfonate.

Surprisingly, according to the present invention, it has been found that many different types of surfaces may be cleaned by applying an aqueous solution wherein the active cleaning ingredient consists essentially of a lignosulfonate.

Surprisingly, it has been found that the lignosulfonate is effective, even without the microbial bacteria, to clean different types of surfaces.

Lignosulfonates are salts of lignin sulfonic acid which is the reaction product of lignin and sulfurous acid which is obtained in the sulfite pulping of wood to obtain cellulose. Various lignosulfonates are known including alkaline metal and alkaline earth metal lignosulfonates and the ammonium lignosulfonates, all of which are suitable for the purposes of the present invention.

The method of the present invention can be applied to many different types of surfaces. Thus, the surface may be either vertical or horizontal or at some other angle. The surface may comprise practically any material as the lignosulfonate is generally not considered to be deleterious to any of the known surfaces. Thus, the lignosulfonate can be applied to all types of flooring material (with appropriate caution taken for materials adversely affected by water).

The concentration of the lignosulfonate in the aqueous solution may vary depending upon the particular use of the cleaning solution. Generally, a ratio of between 3 ml and 60 ml of lignosulfonate per liter of water is satisfactory with a preferred ratio being between 6 ml to 30 ml per liter of water.

The cleaning solution may, if desired, contain other ingredients with the understanding that the main cleaning ingredient is the lignosulfonate. Thus, the cleaning solution may include certain enzymes, surfactants, polymers, etc.

The cleaning solution may be used over a wide PH range—i.e. between 2 and 13.

The cleaning solution will be applied by appropriate means depending on the surface being treated. Thus, it may be poured, sprayed, or wiped on. Appropriate cleaning implements may be used in conjunction with the above.

In some embodiments, and in particular those on a horizontal surface, the cleaning solution may be applied and left for a period of time. Scrubbing implements may be utilized with the remaining solution/debris being appropriately removed.

Having thus generally described the invention, reference will be made to the following examples illustrating embodiments thereof.

EXAMPLE 1

This was conducted at a popular steakhouse which serves meals from brunch to dinner to many thousands of customers weekly. The restaurant has seating for approximately 1200 plus banquet and conference rooms and halls. Previous cleaning efforts included using various types of pads, lemon oil stainless steel polish, stainless steel scratch pads, chisels, knives, spray bottles, buckets and recycled rags. Floors in the kitchen areas tended to become slippery, dry or wet.

Application Procedure:

Step 1: General cleaning—Blended 30 ml of dry ammonium lignosulfonate (ALS) in 4.5 liters of hot water in a mop bucket. The mixture was allowed to let stand for about 5 to 10 minutes.

Step 2: Mopping and degreasing kitchen floors—Blended 45 ml of ALS with 4.5 liters of hot water and was allowed to let stand for at least 90 minutes.

Description of Activity:

1) Cleaned stainless steel salad dressing counter. Left no milky white residue—no lemon oil polish required.

2) Cleaned stainless steel cafeteria style shelves in the plating area.

3) Cleaned wood chopping boards.

4) Cleaned (plastic housing) order-printing machines.

5) Cleaned large oval plastic serving trays.

6) Mopped unfinished floor under plating area.

7) Entire salad prep area including equipment (grill cooking surface, deep fryers, dual burner grill and toaster)

8) Mopped tiled entrance area (30 ml to 9 liters of water). The mop head remained 80% to 90% clean (white) appearance. Floor was not slippery when wet and dried within 45 to 70 seconds.

9) Cleaned steel and glass doors on the kitchen (convection) ovens, without spraying in advance, just using a scratch pad and in seconds—clean stainless steel finish. Using a stainless steel scratch pad the door was completed in less than one minute. In both approaches, staff comments include "your product is stronger, faster and superior (than the harsh/strong chemical previously being used)" and "cleans easily with less effort, energy and time", plus, "the other products do not leave a polished/shiny finish after cleaning".

10) Hood and filter areas above the cooking grills and exterior of the equipment. Product was sprayed on (60 ml to 4.5 liters ratio) the surfaces multiple times and left for about 10 minutes. Cleaning conducted in the same manner as in step 9 above, using the same dilution and cleaning implements.

11) All washrooms were effectively cleaned with the product from "top to bottom". It eliminated foul odors in areas commonly soiled with urine crystals such as mens-room urinals, while the mopping application addressed the floor section beneath the urinals. Toilets, urinals, handles, faucets, seats, counters, paper towel and soap dispensers, sinks and chrome fixtures cleaned to a sparkling shine.

12) Kitchen hoods (under the grilling/cooking areas), cast iron grill plates with hard packed carbon caked in the grates, wire racks in the ovens, metal housing for the lights above the cooking area, were all submerged into two large (app. 23 liters) sinks. One hundred and fifty ml of the product was poured into each sink along with hot water. Solution was mixed by hand using a whisk. The items were soaked for about 45 to 60 minutes prior to being removed without using gloves or protective eyewear. Each item is then aggressively cleaned using the usual cleaning implements and system they would employ with their previous chemical cleaner. The lignosulfonate cleaned the equipment better than their regular chemicals, with less effort and no concern of being in danger of coming into contact with the lignosulfonate. Aside from the fact that they were able to start cleaning earlier than usual, they also used infinitely less cleaning material thus dramatically lowering the cost of this operation.

The staff was interviewed following use of the product and there was a positive reaction as use of the instant composition eliminated multiple cleaning products. Also, working with the product was felt to be safe and it proved to work as well or better than any of the other previous cleaning products used. Furthermore, it eliminated the step of having to apply a stainless steel lemon oil polish to the kitchen.

EXAMPLE 2

This was conducted at a independently owned and operated luxury hotel with extensive meeting and banquet facilities.

Maintenance Procedure:

Housekeeping: cleaning is done on a 24-hour basis with guestrooms done during the day, as well as all of the public areas and a first cleaning of the restaurant in the afternoon. The evening houseperson spot cleans public areas and washrooms, including brass cleaning. The overnight cleaner does the second cleaning of the restaurant, the pool and hot tub area, loading dock, all public washrooms, and the lobbies.

Kitchen: Dishwashers maintain equipment and floor during the day and evening. The evening kitchen shift will commence cleaning of line after initial rush is over. Major floor cleaning is done on the overnight shift by kitchen staff as well. Problem areas to clean are corners and baseboards, as the auto scrubber is too large and bulky to work effectively in those areas.

Housekeeping Application Procedures:

General cleaning—Blended 300 ml of ammonium lignosulfonate in a plastic container with 23 liters of lukewarm water. This mixture was left exposed to air overnight. It was then dispensed into 1 liter spray bottles. This mixture was used initially for all cleaning, including floor cleaning.

Glass cleaning—30 ml of ammonium lignosulfonate per 4.5 liters of lukewarm water was blended in the same type of 23 liter dispensing container. This mixture ratio was found to be more effective for glass cleaning.

Kitchen Application Procedure:

General kitchen cleaning—for kitchen degreasing, a ratio of 90 ml per gallon of lukewarm water was used. Again, the mixture was allowed to sit overnight.

Application Diary:

Housekeeping—The hotel decided to have a special test team of four room attendants and one public area attendant use the product. This was done due to scheduling restrictions.

It was also found that the initial cleaning of guestroom bathtubs, toilets, and sinks took a higher than "normal" amount of scrubbing effort due to the fact that the lignosulfonate was actually removing years of chemical cleaner residue. After the initial use of the product, subsequent cleaning was completed at a much faster and easier pace. It was found that glass and mirror cleaning was more effective using the lower ratio of 30 ml per 4.5 liters. One of the room attendants on the test team told her supervisor that the hotel should be charging more money for the rooms as they were so much cleaner now.

The hotel has 25 smoking rooms in its 155-room inventory located on the $2^{nd}$ floor of the Tower section. Keeping these rooms clean and smelling clean has always been more challenging. During the period of this field test, a cigar smoker occupied one of the smoking rooms, and the room was saturated with smoke. The room was cleaned with the product, as were the drapes and carpet with a light spray of the product. After inspection, the floor supervisor was pleasantly surprised to find the aroma of cigar smoke was gone. Normally, the room would need to be put out of order and aired out for at least a day, along with liberal use of an air freshener.

An area that has always been a challenge is the tile floor of the pool area. Due to inadequate drainage, the floor has a number of "pools" of water left on it which cause staining and creates an algae problem. Normal approach to cleaning these problems would be handled using a concrete acid cleaner (approximately $40.00 per gallon) and the hotel's tri head rotary machine. The cleaning has always been less than effective according to the Executive Housekeeper, as the acid could not be used on the tile border around the pool due to the possibility of contamination of the pool water. The Executive Housekeeper led a team in cleaning the pool deck with lignosulfonate and was delighted with the results. The pool deck was mopped with lignosulfonate and left to sit for about fifteen minutes. Then the rotary machine equipped with soft brushes was run over the deck. The algae was removed, and the pool deck including the edge around the pool itself was scrubbed. The water was tested after some lignosulfonate was allowed to "spill" into the pool, and there was no significant change in either the PH or bromide levels.

The product and the rotary machine then tackled another problem area. The tile floor in one of the men's public washrooms is a textured tile, and regular mopping with a chemical cleaner would leave dirt residues in both the grout and nooks and crannies of the tiles. Again, the representatives used a spray bottle of lignosulfonate to lightly wet down about four 12×12 tiles. The product lay on the floor for 5 minutes. Within seconds of the brushes scrubbing the tile, the dirt literally flaked off of both the tile and the grout.

Initially, the field test was to be restricted to the housekeeping area only. However, some kitchen staff heard of the cleaning effectiveness of lignosulfonate and asked to try it. A demonstration of lignosulfonate was arranged, and the product was used to effectively clean grills in the ovens.

Subsequently, the kitchen received their own 22.5 liter container of lignosulfonate that was used to clean the floor, the hoods, and the stainless steel tables and equipment. The dishwashing staff even found another use when some lignosulfonate was sprayed into a large pot that had burned food on the bottom. After spraying the pot with lignosulfonate and letting it sit for ten minutes, the burned food residue lifted right off. The dishwashing staff member stated that he just had saved himself a good 30 minutes of scrubbing. Even the line cooks started using lignosulfonate by cleaning a salamander in less than 10 minutes, which normally would take twice that time. The thing that really impressed the kitchen staff was the fact that they did not need to wear masks, respirators, heavy aprons, or acid resistant gloves.

It will be understood that the above described embodiments are for purposes of illustration only and that changes and modifications may be made thereto without departing from the spirit and scope of the invention.

I claim:

1. A method of cleaning a surface, the method comprising the step of applying an aqueous cleaning solution to said surface wherein said aqueous cleaning solution consists of water and of a lignosulfonate.

2. The method of claim 1 wherein said lignosulfonate is ammonium lignosulfonate.

3. The method of claim 2 wherein said ammonium lignosulfonate is present in an amount of between 6 ml and 100 ml per liter of aqueous cleaning solution.

4. The method of claim 2 further including the step of leaving said aqueous cleaning solution on said surface for a period of time and subsequently scrubbing said surface.

5. The method of claim 2 wherein said aqueous cleaning solution is applied by spraying.

6. The method of claim 3 wherein said ammonium lignosulfonate is present in an amount of between 6 ml and 30 ml per liter of aqueous cleaning solution.

* * * * *